US007883075B2

(12) United States Patent
Abu-Odeh et al.

(10) Patent No.: US 7,883,075 B2
(45) **Date of Patent: *Feb. 8, 2011**

(54) TENSION GUARDRAIL TERMINAL

(75) Inventors: Akram Y. Abu-Odeh, College Station, TX (US); Dean C. Alberson, Bryan, TX (US); Roger P. Bligh, College Station, TX (US); D. Lance Bullard, Jr., College Station, TX (US); C. Eugene Buth, Wellborn, TX (US)

(73) Assignee: The Texas A&M University System, College Station, TX (US)

( * ) Notice: Subject to any disclaimer, the term of this patent is extended or adjusted under 35 U.S.C. 154(b) by 323 days.

This patent is subject to a terminal disclaimer.

(21) Appl. No.: 12/115,194

(22) Filed: May 5, 2008

(65) Prior Publication Data

US 2009/0272955 A1 Nov. 5, 2009

(51) Int. Cl.
*E01F 15/02* (2006.01)

(52) U.S. Cl. ..... 256/13.1

(58) Field of Classification Search ..... 256/13.1, 256/64; 52/148, 166

See application file for complete search history.

(56) References Cited

U.S. PATENT DOCUMENTS

| | | | | |
|---|---|---|---|---|
| 3,519,301 | A * | 7/1970 | Somnitz | 293/1 |
| 4,928,928 | A * | 5/1990 | Buth et al. | 256/13.1 |
| 5,022,782 | A * | 6/1991 | Gertz et al. | 404/6 |
| 5,078,366 | A * | 1/1992 | Sicking et al. | 256/13.1 |
| 5,348,416 | A * | 9/1994 | Ivey et al. | 404/6 |
| 5,407,298 | A | 4/1995 | Sicking et al. | 404/6 |

(Continued)

FOREIGN PATENT DOCUMENTS

| | | |
|---|---|---|
| WO | WO 00/32878 | 6/2000 |

(Continued)

OTHER PUBLICATIONS

Road Systems, Inc., "How the SKT Functions," http://www.roadsystems.com/skt.htm, 3 pages, printed May 1, 2008.

(Continued)

*Primary Examiner*—Joshua T Kennedy
(74) *Attorney, Agent, or Firm*—Baker Botts L.L.P.

(57) ABSTRACT

A terminal portion of a guardrail safety system includes a terminal portion of a guardrail beam having a downstream end and upstream end. The terminal portion of the guardrail beam slopes from a height appropriate for redirecting an errant vehicle to a height proximate the surface of the ground at an upstream end of the terminal portion. Support posts are installed adjacent a roadway in spaced apart relation to one another and are coupled to the terminal portion of the guardrail beam. A terminal support post is installed adjacent the roadway at the upstream end of the terminal portion of the guardrail beam. The terminal support post couples to an upstream end of the terminal portion of the guardrail beam by a resistive, tensile coupling that maintains tension in the terminal portion of the guardrail beam. The resistive, tensile coupling is maintained between the terminal support post and the guardrail beam during an end-on or re-directive impact by a vehicle. However, the resistive, tensile coupling between the terminal support post and the guardrail beam is released during a reverse-direction impact.

33 Claims, 7 Drawing Sheets

U.S. PATENT DOCUMENTS

| | | | | |
|---|---|---|---|---|
| 5,503,495 | A * | 4/1996 | Mak et al. | 404/6 |
| 5,797,591 | A * | 8/1998 | Krage | 256/13.1 |
| 5,931,448 | A * | 8/1999 | Sicking et al. | 256/13.1 |
| 5,988,598 | A | 11/1999 | Sicking et al. | 256/131.1 |
| 6,065,738 | A * | 5/2000 | Pearce et al. | 256/13.1 |
| 6,089,782 | A * | 7/2000 | Bligh et al. | 404/6 |
| 6,142,452 | A * | 11/2000 | Denman et al. | 256/13.1 |
| 6,488,268 | B1 | 12/2002 | Albritton | 256/13.1 |
| 6,554,256 | B2 * | 4/2003 | Ochoa | 256/13.1 |
| 6,715,735 | B2 * | 4/2004 | Bligh et al. | 256/13.1 |
| 6,719,483 | B1 * | 4/2004 | Welandsson | 404/6 |
| 6,729,607 | B2 * | 5/2004 | Alberson et al. | 256/13.1 |
| 6,783,116 | B2 | 8/2004 | Albritton | 256/13.1 |
| 6,902,150 | B2 | 6/2005 | Alberson et al. | 256/13.1 |
| 7,086,805 | B2 * | 8/2006 | Smith et al. | 404/6 |
| 7,185,882 | B2 * | 3/2007 | Buth et al. | 256/13.1 |
| 7,367,549 | B2 * | 5/2008 | Titmus | 256/13.1 |
| 7,401,996 | B2 * | 7/2008 | Neusch | 404/6 |
| 7,694,941 | B2 * | 4/2010 | Abu-Odeh et al. | 256/13.1 |
| 2002/0066896 | A1 * | 6/2002 | Bligh et al. | 256/13.1 |
| 2002/0179894 | A1 | 12/2002 | Albritton | 256/13.1 |
| 2003/0025112 | A1 * | 2/2003 | Sicking et al. | 256/13.1 |
| 2004/0041140 | A1 * | 3/2004 | Johansson et al. | 256/13.1 |
| 2006/0017048 | A1 * | 1/2006 | Alberson et al. | 256/13.1 |
| 2006/0043353 | A1 * | 3/2006 | Titmus | 256/13.1 |
| 2006/0102884 | A1 * | 5/2006 | Rohde et al. | 256/13.1 |
| 2007/0147957 | A1 * | 6/2007 | Buth et al. | 404/6 |
| 2007/0252124 | A1 * | 11/2007 | Heimbecker | 256/13.1 |
| 2008/0283807 | A1 * | 11/2008 | Titmus | 256/13.1 |

FOREIGN PATENT DOCUMENTS

| | | |
|---|---|---|
| WO | WO 00/40805 | 7/2000 |
| WO | WO 02/29162 | 4/2002 |
| WO | WO 03/064772 | 8/2003 |

OTHER PUBLICATIONS

Road Systems, Inc., "How the FLEAT Functions," http://www.roadsystems.com/fleat.htm, 3 pages, printed May 1, 2008.

Road Systems, Inc., "X-Tension, Fully Re-Directive, Non-Gating Guardrail End Terminal," http://www.roadsystems.com/x-tension.htm, 2 pages, printed May 1, 2008.

Notification of Transmittal of the International Search Report and the Written Opinion of the International Searching Authority, Intl. Application No. PCT/US2009/042850, 15 pages, Aug. 21, 2009.

* cited by examiner

TENSION GUARDRAIL TERMINAL

TECHNICAL FIELD

The present invention relates generally to safety treatment for the ends of W-beam guardrails; and more particularly, to a tensioned guardrail terminal for dissipating impact energy of a car colliding with the end of the W-beam guardrail in an end-on or re-directive impact.

BACKGROUND

Along most highways there are hazards that can be a substantial danger to drivers of automobiles if the automobiles leave the highway. To reduce the severity of accidents due to vehicles leaving a highway, guardrails are provided. The guardrails are installed such that the beam elements are in tension to aid in re-directive type impacts. Guardrails must be installed, however, such that the terminal end of the guardrail facing the flow of traffic is not a hazard. Early guardrails had no proper termination at the ends, and it was not uncommon for impacting vehicles to become impaled on the guardrail causing intense deceleration of the vehicle and severe injury to the occupants. In some reported cases, the guardrail penetrated directly, into the occupant compartment of the vehicle fatally injuring the occupants.

Upon recognition of the problem of proper guardrail termination, guardrail designs were developed that used box beams and W-beams that allow tapering of the end of the guardrail into the ground. Such designs eliminate any spearing effect. While these end treatments successfully removed the danger of the vehicle being penetrated in a head-on collision, it was discovered that these end treatments operate in a ramp-like fashion and may induce launching of the vehicle causing it to become airborne for a considerable distance with the possibility of roll over.

In search for better end treatments, improved energy absorbing end treatments for W-beam guardrail elements were developed. For example, an extruder terminal was developed and typically includes a bending structure that squeezes the guardrail into a flat plate and then bends it about a circular arc directed away from the impacting vehicle. Example extruder terminal products include the ET 2000™ and the ET-PLUS™ offered by Trinity Highway Products. Other extruder terminal products include the SKT 350™ and FLEAT 350™ offered by Road Systems, Inc.

All of these energy absorbing systems use a cable to connect the first w-beam guardrail segment to the first post in the system. The cable provides tension in the guardrail beam element for a redirective hit along the length-of-need portion of the guardrail. A number of cable releasing posts have also been developed for use in these terminals. The cable release posts are intended to release the cable anchor and, thus, release the tension in the system when the post is impacted in either of a forward (end-on) or reverse direction. Such systems are not able to remain in tension during end-on and reverse-direction type impacts.

SUMMARY OF THE INVENTION

The present invention provides a new and improved end treatment for highway guardrails.

In accordance with a particular embodiment of the present invention, a terminal portion of a guardrail safety system includes a terminal portion of a guardrail beam having a downstream end and upstream end. The terminal portion of the guardrail beam slopes from a height appropriate for redirecting an errant vehicle to a height proximate the surface of the ground at an upstream end of the terminal portion. Support posts are installed adjacent a roadway in spaced apart relation to one another and are coupled to the terminal portion of the guardrail beam. A terminal support post is installed adjacent the roadway at an upstream end of the end terminal. The terminal support post couples to an upstream end of the terminal portion of the guardrail beam by a resistive, tensile coupling that maintains tension in the terminal portion of the guardrail beam. The resistive, tensile coupling is maintained between the terminal support post and the guardrail beam during an end-on or re-directive impact by a vehicle. However, the resistive, tensile coupling between the terminal support post and the guardrail beam is released during a reverse-direction impact.

Technical advantages of particular embodiments of the present invention include a guardrail end treatment that dissipates impact energy through the compression of a W-beam guardrail element. Thus, one advantage may be that the guardrail end treatment is energy absorbing. Another advantage may be that the end treatment forces the W-beam guardrail element through a flattening structure that squeezes the guardrail into a relatively flat plate. Specifically, the guardrail end treatment may dissipate impact energy of a vehicle colliding with an end of a guardrail by flattening a portion of the guardrail.

Still another advantage may be that an end of the W-beam guardrail element extends through the flattening structure and tapers to the ground. The W-beam guardrail element may be secured to the ground in tension. The components of the system that provide the tensile connection of the guardrail beam to the terminal support post may enable the guardrail beam to remain secured after an end-on or re-directive impact. Thus, the system may remain in tension during both types of impacts. Still another advantage may be that the tension is released when the system is impacted in the reverse direction near the terminal end, however. The releasing of tension in the guardrail element for reverse direction impacts prevents vehicle instability and excessive deceleration.

Other technical advantages will be readily apparent to one skilled in the art from the following figures, descriptions and claims. Moreover, while specific advantages have been enumerated above, various embodiments may include all, some or none of the enumerated advantages.

DETAILED DESCRIPTION OF EXAMPLE EMBODIMENTS

Existing guardrail end treatments have proven to be unsafe for some collision conditions that happen on the highway, sensitive to installation details, and/or very costly. However, the end treatment described below is a safety treatment for the ends of a W-beam guardrail that provides a higher level of performance over a wider range of collision conditions and reduces end treatment costs and the number of injuries and deaths associated with guardrail terminal accidents. The described system maintains the tension in the guardrail beam element during both end-on and re-directive type impacts. When the system is impacted in the reverse direction near the terminal end, however, the anchorage system may release to prevent vehicle instability or excessive deceleration.

Figure 1:
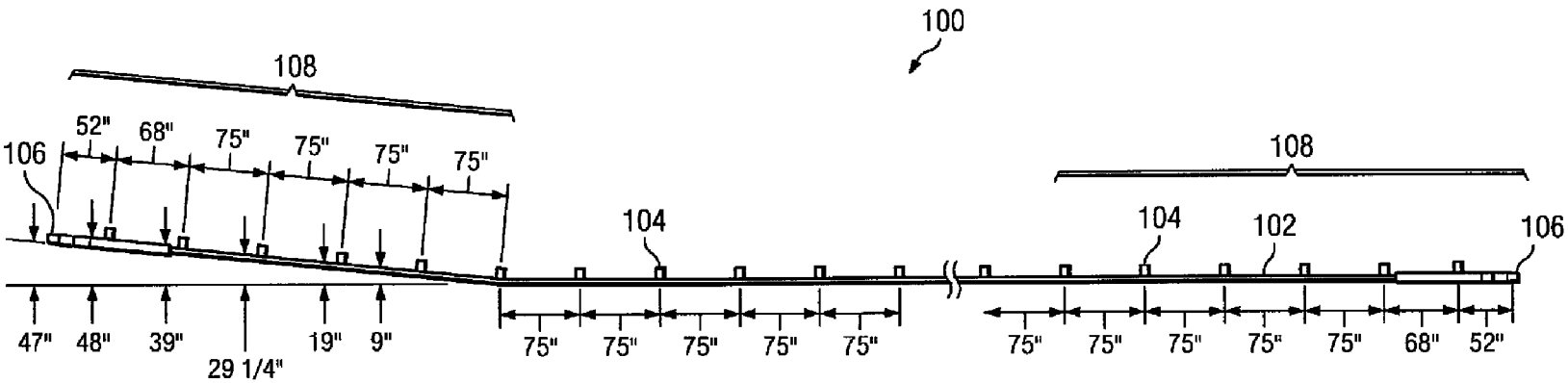
FIG. 1 illustrates a top view of an exemplary guardrail safety system that incorporates certain aspects of the present invention.

FIG. 1 illustrates a guardrail safety system 100 that incorporates certain aspects of the present invention. Guardrail system 100 may be installed adjacent a roadway 101, to protect vehicles, drivers and passengers from various obstacles and hazards, and prevent vehicles from leaving the roadway 101 during a traffic accident or other hazardous condition. Guardrail systems that incorporate aspects of the present invention may be used in median strips or shoulders of highways, roadways, or any path that is likely to encounter vehicular traffic.

Guardrail system 100 includes a guardrail beam 102 and support posts 104 that anchor guardrail beam 102 in place along the road way 101. In a particular embodiment, guardrail beam 102 may include multiple 12-gauge W-beam rail elements of a length on the order of approximately 12.5 feet or 25 feet. The guardrail beam sections may be mounted at a height of on the order of approximately 27 to 31 inches with rail splices positioned mid-span between the support posts 104. Guardrail beam 102 and the terminal end of guardrail beam 102, specifically, are illustrated in more detail in FIGS. 4A and 4B and will be described below.

Guardrail beam 102 is attached to support posts 104 with connectors that may include, in particular embodiments, slotted countersunk bolts such as, for example, 16 mm (⅝-inch) diameter by 38 mm (1½-inch) long flat slot machine screws. Oversized guardrail nuts may be used on the back side of the support post 104. Support posts 104 may be embedded in the ground, a concrete footing, or a metal socket. Support posts 104 may be made of wood, metal, plastic, composite materials, or any combination of these or other suitable materials. It is also recognized that each support post 104 within guardrail system 100 need not necessarily be made of the same material or include the same structural features. Furthermore, the cross-section of support posts 104 may be any engineered shape suitable for releasably supporting guardrail beam 102. Such cross-sectional shapes may include, but are not limited to, square, rectangular, round, elliptical, trapezoidal, solid, hollow, closed, or open.

Guardrail system 100 is intended to keep errant vehicles from leaving roadway 101 during a crash or other hazardous situation. In many instances, guardrail 100 is installed between roadway 101 and a significant hazard to vehicles (e.g., another roadway, a bridge, cliff, etc.). Therefore, guardrail system 100 should be designed to withstand a significant impact from a direction generally perpendicular to roadway 101, without substantial failure. It is this strength that allows guardrail system 100 to withstand the impact, and still redirect the vehicle so that it is once again traveling generally in the direction of roadway 101.

However, testing and experience has continuously shown that guardrail systems may actually introduce additional hazards to the roadway and surrounding areas. This is particularly true with respect to vehicles that impact the guardrail system adjacent its terminal section, in a direction generally parallel to the roadway. For example, if the guardrail system were rigidly fixed in place during a crash, serious injury and damage may result to the errant vehicle, its driver and passengers. Accordingly, many attempts have been made to minimize this added risk. Such methods generally include the use of terminal portions that are tapered from the ground up to effectively reduce the impact of head on collisions and to create a ramp-like effect that causes vehicles to go airborne during a crash. Other methods include breakaway cable terminals (BCT), vehicle attenuating terminals (VAT), SENTRE end treatments, breakaway end terminals (BET) and the breakaway support posts of U.S. Pat. No. 6,398,192 ("'192 patent"). Many-such terminals, supports, end treatments and the like are commercially available from various organizations. Examples include the HBA post by Exodyne Technologies and Trinity Industries, and a breakaway support post similar in configuration to that described in the '192 patent.

Referring again to FIGS. 1 and 2, guardrail system 100 includes one terminal post 106 and seven support posts 104. Collectively, this configuration forms a terminal section 108 of guardrail system 100. As shown, terminal section 108 is employed in a preferred embodiment as an end terminal for a conventional guardrail assembly 100.

Although FIG. 1 is illustrated with dimensions and depicts one exemplary embodiment, it is understood that the dimensions of guardrail system 100 may vary depending on the nature of the roadside hazard being shielded. As illustrated, each terminal section 108 has a length on the order of approximately 35 feet. However, the dimensions of terminal section 108 may vary as needed. Additionally, the length of the length-of-need portion of the system may of any appropriate length required by the conditions of roadway 101.

Terminal section 108 may be installed either parallel to roadway 101 or at an angular departure from roadway 101, as shown best in FIG. 1. Additionally, while the terminal section 108 at one end of the guardrail safety system may be flared, the terminal section 108 at the opposite end of the system may not be flared, in certain embodiments. For example, in the embodiment depicted in FIG. 1, an upstream terminal section 108 is flared while a downstream terminal section 108 is not flared. Specifically, the upstream terminal sections 108 is flared away from roadway 101 in a substantially linear manner while the downstream terminal section 108 remains substantially parallel to roadway 101. In other embodiments, both terminal sections 108 may be flared or unflared in a similar manner. Additionally, it is recognized that other configurations may be used for terminal sections 108. For example, one or both of terminal sections 108 may be installed at a parabolic flare away from the roadway. A parabolic flare may be accomplished by increasing the offset of each support post in a generally parabolic progression as the terminal portion proceeds upstream. Where incorporated, positioning of one or more of terminal sections 108 at a flared or angular departure away from roadway 101 may permit the terminal sections 108 to perform a gating function by facilitating movement of the impacting vehicle to the side of the rail opposite roadway 101 as the vehicle progresses.

In a particular embodiment where terminal section 108 is linearly flared, terminal section 108 may be flared back at an angle of approximately 6 to 7 degrees from the non-terminal portion of the guardrail. Where support posts 104 of terminal section 108 are spaced apart at intervals of approximately 75 inches, the most downstream post 104 of terminal section 108 may be approximately 9 inches offset from a line tangent to the non-terminal portion of the guardrail, in a particular embodiment. Moving toward the upstream end of terminal section 108, the next four successive support posts 104 may be 19, 29.25, 39, and 48 inches offset from a line tangent to the non-terminal portion of the guardrail, in this embodiment. Terminal post 106, which may be positioned directly below guardrail beam 102, may be approximately 47 inches offset from a line tangent to the non-terminal portion of the guardrail, in the described embodiment.

Figure 2:
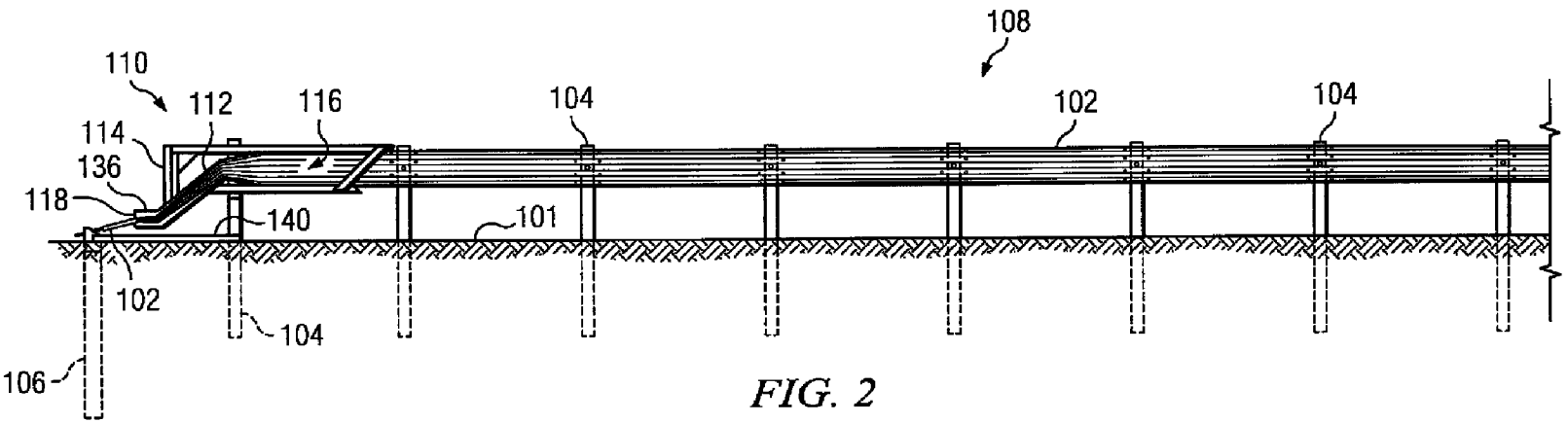
FIG. 2 illustrates a side view of a terminal portion of a guardrail system that incorporates certain aspects of the present invention.

As shown better in FIG. 2, terminal section 108 includes an end treatment 110. End treatment 110 includes a flattening chute 112 and a front striking plate 114. End treatment 110 and flattening chute 112, specifically, is mounted onto a first post 104 by fasteners such as bolts. The purpose of end treatment 110 is to dissipate impact energy of the vehicle without creating a dangerous condition such as causing the vehicle to roll-over or allow the guardrail 102 to spear the vehicle or the occupant compartment of the vehicle.

Guardrail beam element 102 feeds into an inlet 116 at a downstream end of flattening chute 112. Guardrail beam element 102 is disposed within flattening chute 112 and extends the length of flattening chute 112. Guardrail beam element 102 exits an outlet 118 at an upstream end of flattening chute 112. As will be described in more detail with regard to FIG. 3, the dimensions of flattening chute 112 results in a terminal portion of the guardrail beam 102 tapering to the ground. The portion of guardrail beam element 102 exiting outlet 118 is flattened vertically such that the terminal portion of guardrail beam element 102 resembles a stack of four flat plates.

A terminal post 106 secures the terminal end of guardrail beam element 102 to the ground and places guardrail beam element 102 in tension. As will be described in more detail with regard to FIGS. 8A and 8B and 10A and 10B, the coupling of guardrail beam element 102 to terminal post 106 enables guardrail beam element 102 to remain secured in tension to terminal post 106 after either of an end-on or re-directive impact by a vehicle leaving roadway 101. However, the components effecting the tensile coupling enables the tension in guardrail beam element 102 to be released when the system is impacted in the reverse direction near the terminal end. The releasing of tension in the guardrail element for reverse direction impacts prevents vehicle instability and excessive deceleration.

Figure 3:
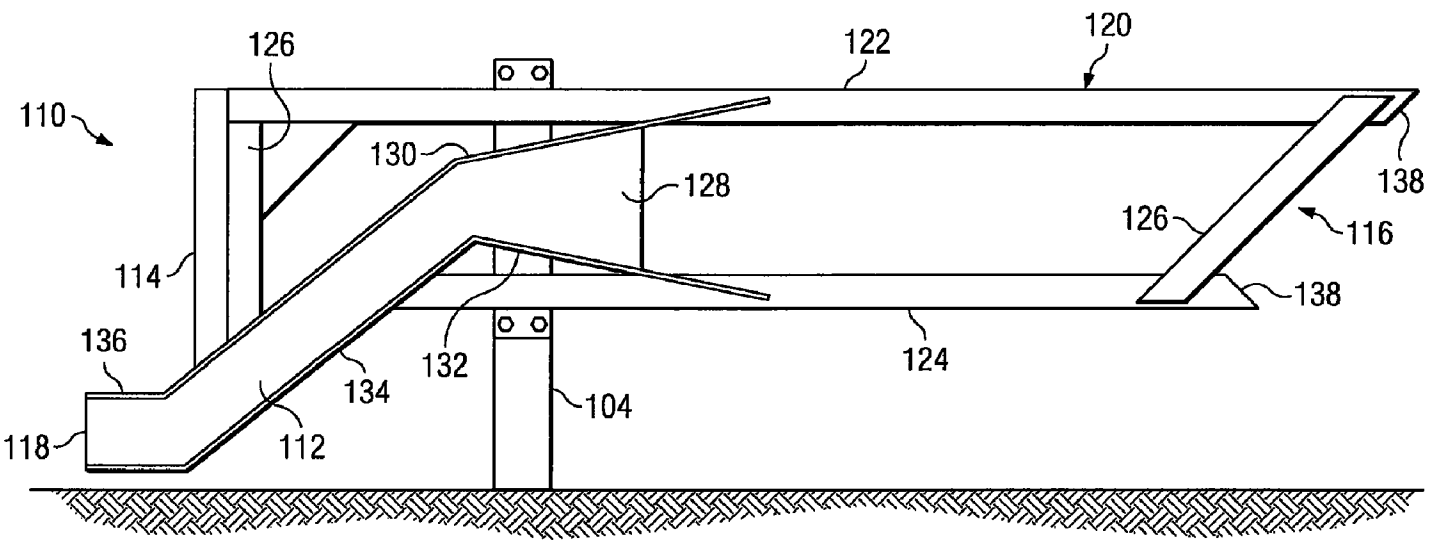
FIG. 3 illustrates a side view of an exemplary embodiment of an end treatment in the terminal portion of a guardrail system, in accordance with a particular embodiment of the present invention.

FIG. 3 illustrates an exemplary embodiment of end treatment 110 in greater detail. As described above, end treatment 110 includes a flattening chute 112 and a front striking plate 114. Flattening chute 112 and front striking plate 114 are coupled to an extruder 120. Extruder 120 surrounds the upstream portion of guardrail beam member 102 and is made up of an upper, U-shaped channel member 122 and a lower, U-shaped channel member 124, which are secured in a spaced relation to one another by strap plates 126.

The vertical distance between channel members 122 and 124 is an appropriate distance such that guardrail beam 102 is inserted into the channel created by extruder 120. For example, where guardrail beam 102 comprises a 12-gauge W-beam rail element having a vertical dimension of approximately 12.25 inches, the distance between the top of channel member 122 and the bottom of channel 124 may be approximately 14 inches, in a particular embodiment.

Front striking plate 114 is secured by welding to extruder 120 of end treatment 110. Front striking plate 114 may be vertically elongated, in particular embodiments. Thus, front striking plate 114 may extend both above and below extruder 120 to permit front striking plate 114 to be easily engaged by either the high bumper of trucks, SUV's, and other taller vehicles and the low set bumpers of smaller cars impacting in a frontal manner. Front striking plate 114 is also positioned so as to engage the vehicle frame or rocker panel to reduce vehicle intrusion when the upstream end of end treatment 110 is impacted by a vehicle in a sideways manner.

Flattening portion 112, which is mounted to extruder 120, may be constructed from four metal plates, in a particular embodiment. The four metal plates may be cut and/or bent and then welded together to form the desired configuration. Alternatively, flattening portion 112 may be formed from more than four pieces or from a single piece of metal that is cut and bent into the desired configuration. When flattening portion 112 is assembled, flattening portion 112 may form an enclosed structure that houses a terminal portion of guardrail beam 102.

In the illustrated embodiment, flattening portion 112 includes three sections. The most downstream portion of flattening portion 112 includes a throat 128. The vertical dimension of throat 128 is greater at the downstream end and decreases as it approaches the upstream end of end treatment 110. For example, in a particular embodiment, the vertical dimension of throat 128 may be approximately 14 inches wide at the downstream end and approximately 4.5 inches wide at the upstream end. The horizontal length of throat 128 may be within a range of approximately 11 to 13 inches.

In a particular embodiment, the slope of a lower edge 132 may be greater than the slope of an upper edge 130. The increased slope of lower edge 132 may aid in the flattening of guardrail beam 102 during an impact. For example, in a particular embodiment, upper edge 130 may slope upward at an angle of approximately 11 degrees from the horizontal, and lower edge 132 may slope downward at an angle of approximately 13 degrees from the horizontal. In still other embodiments, the slope of upper edge 130 and lower edge 132 may be substantially the same. Thus, in a particular embodiment, upper edge 130 and lower edge 132 may symmetrically mirror one another. In still other embodiments, one of top edge 130 and lower edge 132 may be aligned with the horizontal (substantially parallel with the roadway) while the other of top edge 130 and lower edge 132 slopes upward or downward, respectively.

A mid portion 134 extends from the upstream end of throat 128 and slopes toward the ground. Specifically, mid portion 134 is configured to transition guardrail beam element 102 from a height above the ground level that is appropriate for redirecting an impacting vehicle (31 inches, in a particular embodiment) to a height that is proximate the ground's surface. Thus, mid portion 134 extends from a vertical distance associated with throat 128 at a downstream end to approximately ground level at an upstream end. In a particular embodiment, where the horizontal length of mid portion 134 is approximately 18.75 inches, mid portion 134 may slope at an angle of approximately 38 degrees from the horizontal.

Mid portion 134 also provides a channel through which a terminal portion of guardrail beam element 102 is disposed. In a particular embodiment, the vertical dimension of the channel within mid portion 134 may be approximately 4.5 inches (similar to the width of throat 128 at the upstream end). The dimensions of the channel within mid portion 134 may remain substantially constant such that the vertical dimension of the channel within mid portion 134 at the downstream end is the substantially the same as the vertical dimension of the channel within mid portion 134 at the upstream end.

A third portion of flattening portion 112 includes outlet portion 136. Outlet portion 136 extends from the upstream end of mid portion 134. Outlet portion 136 is disposed proximate the grounds' surface and is in substantial alignment with the grounds' surface. Outlet portion 136 also forms a channel through which the terminal end of guardrail beam element 102 exits the flattening chute 112. In a particular embodiment, the vertical dimension of the channel within outlet portion 136 may be approximately 4.5 inches (similar to the vertical dimension of the channel within mid portion 134). The dimensions of the channel within outlet portion 136 may remain substantially constant such that the vertical dimension of the channel at the downstream end of outlet portion 136 is substantially the same as the vertical dimension of the channel at the upstream end of outlet portion 136. In a particular embodiment, the horizontal length of outlet portion 136 may be approximately 5-7 inches.

As stated above with regard to FIG. 2, guardrail beam member 102 is disposed within and extends throughout the length of flattening portion 112. Specifically, guardrail beam member feeds into an inlet 116 at a downstream end of flattening chute 112. Guardrail beam element 102 traverses the length of flattening chute 112 and exits an outlet 118 at an upstream end of flattening chute 112. Thus, a terminal end of the W-beam guardrail element extends through the flattening structure. The slope of mid portion 134 toward the ground in the upstream direction results in guardrail beam element 102 being gradually transitioned toward the ground over the length of flattening portion 112. After exiting the outlet 118, guardrail beam element 102 is secured to a terminal post 106 at ground level.

During an end-on or oblique end-on collision of a vehicle with front striking plate 114, end treatment 110 may be displaced in a downstream direction and downstream portions of guardrail beam element 102 may be forced into the displaced end treatment 110. During such a collision, extruder 120 functions as a guide to guide guardrail beam element into flattening portion 112. Extruder 120 includes guides 138 that prevent shaving of the W-beam guardrail element 102 by ends of extruder 120 as extruder 120 moves along the length of the guardrail beam element 102 during a collision. The guides 138 accommodate any irregularities or bumps in guardrail beam element 102 to ensure proper feeding of guardrail beam element 102 into flattening portion 112.

As end treatment 110 moves along guardrail beam element 102 and downstream portions of guardrail beam element 102 are forced into flattening portion 112, guardrail beam element 102 is flattened vertically. Portions of guardrail beam element 102 exiting outlet 118 of flattening portion 112 are flattened into what may appear to be four vertically stacked plates. For example, where the vertical dimension of guardrail beam element 102 is approximately 12.25 inches and throat portion 134 of flattening portion 112 is approximately 4.5 inches, the vertical dimension of the flattened portion of guardrail beam element 102 may be less than approximately 4.5 inches. As this flattening process occurs, substantial energy is dissipated slowing the impacting vehicle.

Figure 4A:
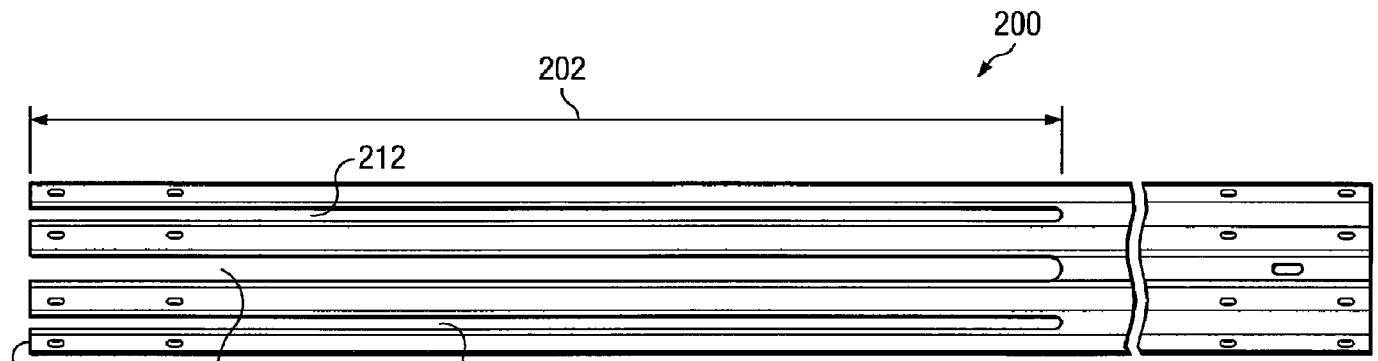
FIGS. 4A and 4B illustrate a side view and a profile view, respectively, of a modified guardrail beam that incorporates certain aspects of the present invention.
Figure 4B:
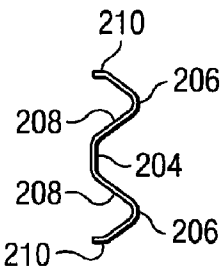

To aid in initial flattening of guardrail beam element 102 for coupling to terminal support post 106, a terminal end of guardrail beam element 102 may be modified. FIGS. 4A and 4B illustrate a modified guardrail beam element 200 in accordance with one embodiment. As shown in FIG. 4A, the guardrail beam element 200 includes a slotted zone 202 at the upstream end of the terminal portion of guardrail beam element 200. In a particular embodiment, slotted zone 202 comprises a series of slots longitudinally disposed in the guardrail beam element 200. The use of three slots has proven effective in testing models of guardrails constructed similar to guardrail safety system 100.

Slotted zone 202 may initiate at a terminal end 203 of guardrail beam element 200 and extend a desired distance downstream. The horizontal length of slotted zone 202 may vary depending on the horizontal length of end treatment 110. It may be desirable for slotted zone 202 to include the portion of guardrail beam element 200 that is coupled to terminal post 106 and the portion of guardrail beam element 200 that traverses through flattening portion 112. Generally, slotted zone 202 may extend from the terminal, upstream end of guardrail beam element 200 to some distance between the first and second support posts 104. Where, for example, the dimensions of the terminal section 108 of guardrail system 100 are similar to those illustrated in FIG. 1, slotted zone 202 may extend approximately 80-85 inches from the terminal end of guardrail beam element 200.

The placement of the slots in slotted zone 202, according to a particular embodiment, may be better understood with reference to the cross-section for a typical W-beam guardrail 200 as shown in FIG. 4B. A valley 204 is positioned between upper and lower peaks 206 and is formed at the intersections of inclined web portions 208. Edge members 210 laterally out lie each peak 206. Highly preferred placement for the slots is proximate each peak 206 and the valley 204. Thus, in the illustrated embodiment of FIG. 4A, first and second slots 212 are placed in the first and second peaks 206, respectively. A third slot 214 is placed in valley 204.

Slots 212 and 214 should be of a size sufficient to enhance the ability of the terminal end of guardrail beam element 200 to be flattened. In a preferred embodiment, the entire vertical dimension of each peak 206 and valley 204 may be removed. Effective sizes for slots 212 have been found to be approximately 0.5 inches, as measured vertically. An effective size for slot 214 has been found to be approximately 0.75 inches, as measured vertically. Thus, in a particular embodiment, slots 212 may have a width on the order of 0.5 inches and extend approximately 81-82 inches. Slot 214 may have a width on the order of approximately 0.75 inches and extend approximately 81-82 inches. The provided dimensions are for example purposes only, however. Any dimensions may be used for slots 212 and 214 to enhance the ability of guardrail beam 200 to be flattened into four vertically stacked plates throughout the terminal end of guardrail beam element 200.

While guardrail beam 102 may include W-beam rail elements, it is generally recognized that the illustrated guardrail beam 102 is merely an example of a beam that may be used in a guardrail system. Guardrail beams 102 or portions of guardrail beams 102 may include conventional W-beam guardrails, three beam guardrails, box beams, wire ropes, or other structural members suitable for redirecting an errant vehicle upon impact. It is also recognized that the configuration and dimensions of any of the above-described elements within guardrail system 100 may vary as desired.

Returning to FIGS. 1 and 2, following the initial end-on impact of a vehicle with end treatment 110 and the initiation of the displacement of end treatment 110 in a downstream direction, the impacting vehicle and end treatment 110 may engage one or more support posts 104. Where the support posts 104 comprises steel yielding support posts that are modified at ground level, the impacted support posts 104 may release guardrail beam element 102 as they are impacted and bent toward the ground. Thus, support posts 104 that are impacted during the collision may be displaced, in certain embodiments, such that they do not pose a hazard to the impacting vehicle. Although guardrail beam 102 may be released from impacted support posts 104, portions of guardrail beam element 102 downstream from the impact may remain in substantially their original position relative to the ground's surface. Further, because guardrail beam 102 remains coupled to terminal post 106 during an end-on or re-directive impact, guardrail beam 102 remains in tension. This extends the range of acceptable performance of guardrail safety system 100.

The tension in guardrail beam 102 may also be retained in this manner when guardrail system 100 is subject to a redirective impact in the length of need portion of guardrail system 100. For example, when an impacting vehicle traveling in a direction substantially parallel to the downstream direction of guardrail system 100 leaves the roadway and impacts guardrail system 100, any support posts 104 impacted by the vehicle may operate to release guardrail beam element 102 as they are impacted. Modified support posts 104 may be bent toward the ground such that the support posts 104 are displaced and do not pose a hazard to the impacting vehicle. Because the tension in guardrail beam 102 is maintained, guardrail beam element 102 continues to operate to redirect the vehicle back onto the roadway even after one or more support posts are released from guardrail beam element 102.

Figures 5A, 5B, 5C, 6A, 6B, 6C, 7A, 7B, 7C:
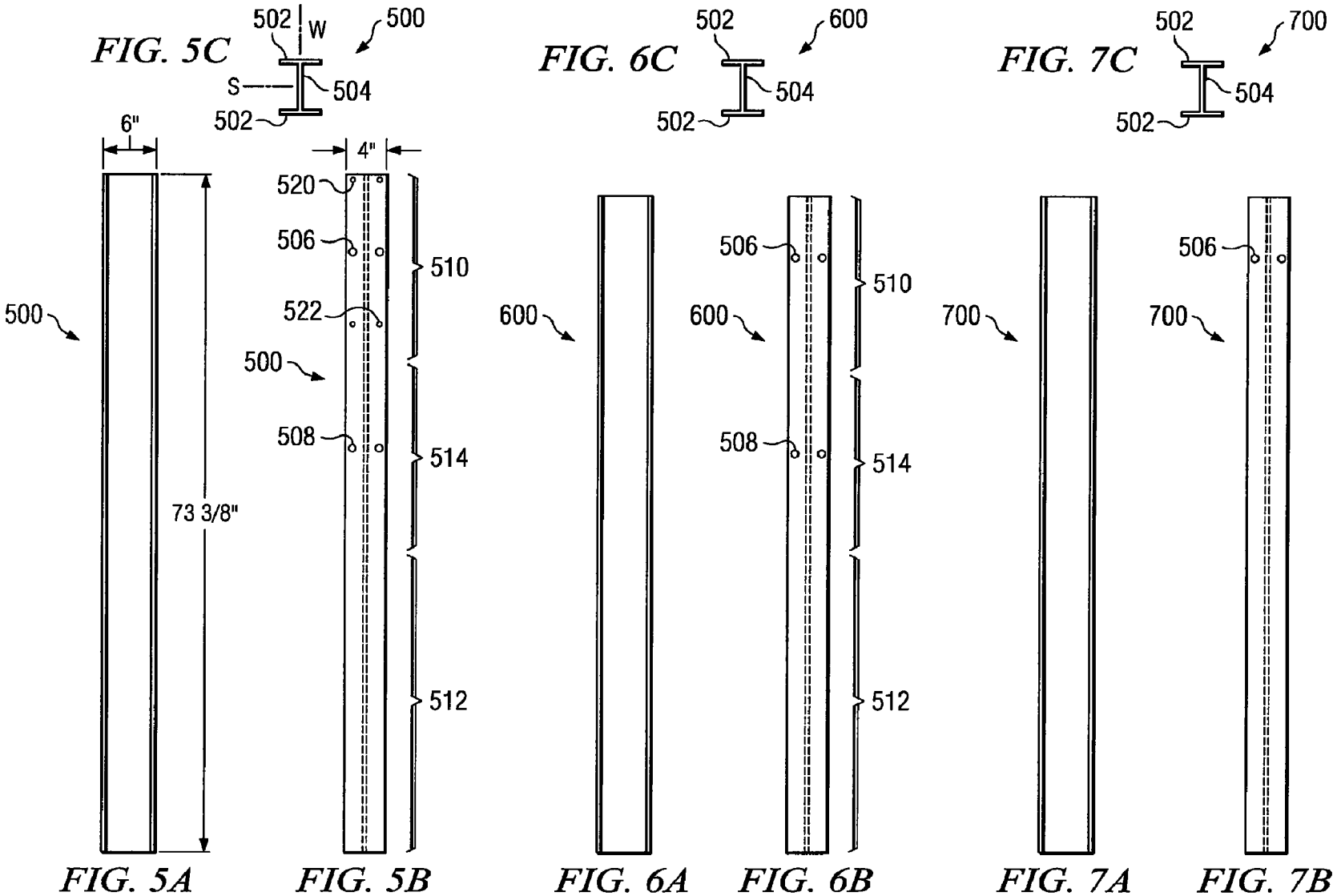
FIGS. 5A-5C illustrate an exemplary weakened support post suitable for use in a guardrail safety system, in accordance with a particular embodiment of the present invention.
FIGS. 6A-6C illustrates another exemplary weakened support post suitable for use in a guardrail safety system, in accordance with a particular embodiment of the present invention.
FIGS. 7A-7C illustrates an exemplary unmodified support post suitable for use in a guardrail safety system, in accordance with a particular embodiment of the present invention.

FIGS. 5A-5C, 6A-6C, and 7A-7C illustrate example embodiments of support posts that may be used in conjunction with guardrail system 100 of FIG. 1. Specifically, FIGS. 5A-5C illustrate an exemplary weakened support post that may be used as a first support post 500 (after the terminal support post 106) in the terminal section 108 of guardrail safety system 100. FIGS. 6A-6C illustrate an exemplary weakened support post 600 that may be used throughout terminal section 108 and other portions of guardrail safety system 100. FIGS. 7A-7C illustrate a standard line post 700 that may be used in certain portions of guardrail safety system 100. Although FIGS. 5A-5C, 6A-6C, and 7A-7C illustrate three distinct embodiments, respectively, like reference numerals have been used to identify parts common to the three embodiments.

As illustrated, support posts 500, 600, and 700 include elongate, continuous structural members and are each of a standard wide flange configuration. Each support post includes two flanges 502, that are generally parallel with one another, and in spaced apart relation from one another. A web 504 forms the coupling between flanges 502. In a preferred embodiment, flanges 502 include a generally identical configuration of boltholes 506 and cutouts 508, therein.

With regard to the wide flange shape used as a guardrail post, the cross section is typically shaped like the letter "H". The cross section has two major axes for bending. The "weak" axis generally refers to a central axis that extends through the web and is perpendicular to the flanges. The "strong" axis generally refers to a central axis that is perpendicular to the web and parallel to the planes of the flanges. The weak axis for a conventional installation of guardrail extends generally transversely to the road. The strong axis extends generally along the roadway.

In the illustrated embodiment of FIGS. 5A-5C, 6A-6C, and 7A-7C the wide flange is a standard W6×8.5, which is commonly used in fabricating support posts for guardrail installations. A standard W6×8.5 wide flange may have a nominal six-inch depth and weigh eight and one-half pounds per foot. In fact, one advantage of the present invention is the ability to re-use existing, standard equipment to fabricate, modify, and install support post 500, without substantial modification to the equipment. Those of ordinary skill in the art will recognize that wide flange beams may be available in many different sizes. For example, a wide flange having a six-inch depth and weighing nine pounds per foot may also be used. Such a wide flange is referred to as a W6×9 wide flange. However, a W6×9 wide flange and a W6×8.5 wide flange are considered equivalent in the trade. The terms "W6×8.5 wide flange" and "W6×9 wide flange" are intended to refer to all sizes and configurations of guardrail posts that may be referred to as "W6×9" by a person of ordinary skill in the art. In addition, persons skilled in the art recognize other names used for wide flanges include but are not limited to "I-beam," "H-beam," "W-beam," "S-beam," "M-beam," or the term "shape" may be substituted for "beam."

Support posts 500, 600, and 700 have a length in a range of approximately 72 and 73⅜ inches, in particular embodiments, and include an upper portion 510 and a lower portion 512. A mid portion 514 couples upper portion 510 with lower portion 512. Upper portion 510 includes two boltholes 506 that are adapted to receive connectors for the installation of a guardrail beam (e.g., guardrail beam 102) upon the support post. Lower portion 512 is suitable for installation below grade, as part of a guardrail support system.

Bolt holes 506 include a standard configuration that allow for the installation of widely used guardrail beams, upon the respective support post. In general, bolt holes 506 align with the center of the guardrail beam, and maintain the center of the guardrail beam approximately 30 inches above grade. However, the number, size, location and configuration of boltholes 506 may be significantly modified, within the teachings of the present invention.

Support posts 500 and 600 are each modified to include a relatively "weak" axis W, and a relatively "strong" axis S. Support posts 500 and 600 are normally installed along a roadway such that weak axis W is generally perpendicular to the direction of traffic, and strong axis S is generally parallel to the direction of traffic. Accordingly, support posts 500 and 600 are typically able to withstand a significant impact (e.g., with a car traveling at a high rate of speed) about the strong axis S without substantial failure. However, support posts 500 and 600 are intentionally designed such that failure will more readily occur in response to an impact about the weak axis W. Stated differently, support posts 500 and 600 exhibit adequate strength in the lateral direction but sufficiently low strength in the longitudinal direction. Accordingly, if a vehicle impacts end treatment 110 "end-on", support posts 500 and 600 will tend to fail (e.g., buckle), while allowing the vehicle to decelerate as it impacts consecutive support posts. However, if a vehicle strikes guardrail system 100 along the face of and at an angle to guardrail beam 102, support posts 500 and 600 will provide sufficient resistance (strength) to redirect the vehicle along a path generally parallel with guardrail beam 102.

Mid portions 514 of support posts 500 and 600 include two cutouts 508, which are configured to further weaken the support posts about the weak axis W, to more readily allow for failure due to impact from a vehicle along that direction. Cutouts 508 are positioned within mid portion 514 to weaken the support posts about weak axis W, adjacent grade (when installed). This will accommodate failure of the support posts approximately at grade, allowing support posts 500 and 600 to "fold" over from the point of failure, upward. Since lower portion 512 is below grade, it is not expected that the ground, or lower portion 512 of the support post will appreciably deflect during an impact.

Since cutouts 508 are intended to occur approximately at grade, and the center of boltholes 506 are intended to occur 30 inches above grade, boltholes 506 occur 30 inches above cutouts 508, in the illustrated embodiment. It will be recognized by those of ordinary skill in the art that the size, configuration, location and number of boltholes, cutouts, and their relationship with each other, may be varied significantly within the teachings of the present invention. The overall length of the support posts, and their respective upper, lower and mid portions may vary significantly, within the teachings of the present invention. For example, in other embodiments, cutouts 508 may occur below grade or above grade. The depth of cutouts 508 below grade should not exceed an amount that will prevent the support posts from failing at or near the location of cutouts 508. At some depth below grade, the surrounding earthen (or other) material will reinforce lower portion 512 of the support posts to an extent that will no longer accommodate such failure to occur.

The height of cutouts 508 above grade should not exceed a point at which the support post will fail at cutouts 508, and leave a "stub" above grade which can snag vehicles, and otherwise cause excessive injury and/or excessive damage. Such a stub could be detrimental to the redirective effect of the guardrail system in which the support post is operating.

The vertical dimension of a cutout 508 is limited based upon the horizontal dimension of cutout 508. For example, a ratio of the vertical dimension of any particular cutout may be equal to, or less than three times the horizontal dimension. Alternatively, the ratio may be limited to two times the horizontal dimension. In the illustrated embodiments, the ratio is 1:1, since cutout 508 is generally a circular opening in the support post. The smaller the vertical dimension of the cutout, the more precisely the designer may dictate the point of failure along the vertical length of support posts 500 and 600.

Various configurations of cutouts 508 are available to a designer of support posts 500 and 600, in accordance with the teachings of the present invention. For example, rather than circular openings, cutouts 508 may comprise square, rectangular, triangular, oval, diamond shaped, or practically any other geometric configuration, and still obtain some or all of the benefits described herein.

The horizontal orientation of cutouts 508 within flanges 502 may also be altered significantly, within the teachings of the present invention. In the illustrated embodiments of FIGS. 5A-5C and 6A-6C, the centerline of cutouts 508 is located approximately one inch from the centerline of flanges 508. However, in alternative embodiments, cutouts 508 may be located closer to such edges, or further from such edges. In one embodiment, cutouts 508 may be configured such that they extend all the way to the edge of the flange, such that there is a break in material beginning at the edge. In this manner, a traditional punch could be employed at the edge, to form a semi-circular opening that extends to the edge of the flange.

Alternatively, a sawcut could be employed from the outer edge of the flange, and extending inward, to form cutouts 508. In this manner, the sawcut would form the starting point of the likely point of failure along the weak axis of the support post. Rather than a sawcut, a similar configuration may include a slot in which the longest dimension extends horizontally through the flange. Such a slot may begin or terminate at the edge of the flange, or otherwise be disposed completely within the material of the flange.

As stated above, FIGS. 5A-5C specifically illustrate a guardrail support post 500 that may be used as the first support post (after the terminal support post 106) in a guardrail system 100. Where an end treatment such as end treatment 110 is incorporated into guardrail safety system 100, support post 500 may be modified to support an end treatment 110. Specifically, support post 500 includes additional boltholes 520 and 522 for coupling end treatment 110 to support post 500. In the particular illustrated embodiment, boltholes 520 and 522 are slightly smaller than boltholes 506 and cutouts 508. It is recognized, however, that the provided dimensions of boltholes 520 and 522 are provided for example purposes only and may vary as appropriate for coupling the end treatment 110 to support post 500. In contrast to support post 500, support posts 600 and 700 do not include additional boltholes 520 and 522 and, thus, are more appropriately used in portions of the guardrail system 100 that are not directly supporting end treatment 110.

Although W6×8.5 wide flanges are described above and illustrated within this specification, it should be recognized by those of ordinary skill in the art that practically any size guardrail support post may be weakened as described above. The size, weight and configuration of the support post are just a few factors to be considered to determine the appropriate location of cutouts, to allow yielding along the weak axis while maintaining sufficient strength along the strong axis to redirect impacting vehicles. Further, although it may be desirable for at least a portion of the support posts in the guardrail safety system 100 to include weakened support posts such as support posts 500 and 600 of FIGS. 5A-5C, supports posts may also include conventional, unmodified support posts or other structural members suitable for supporting a guardrail beam. FIGS. 7A-7C illustrate such an unmodified support post. Support post 700 does not include cutouts 508 and may comprise standard line posts such as unmodified W6×8.5 posts or any other support post of an appropriate size, weight and configuration.

Figures 8A, 8B:
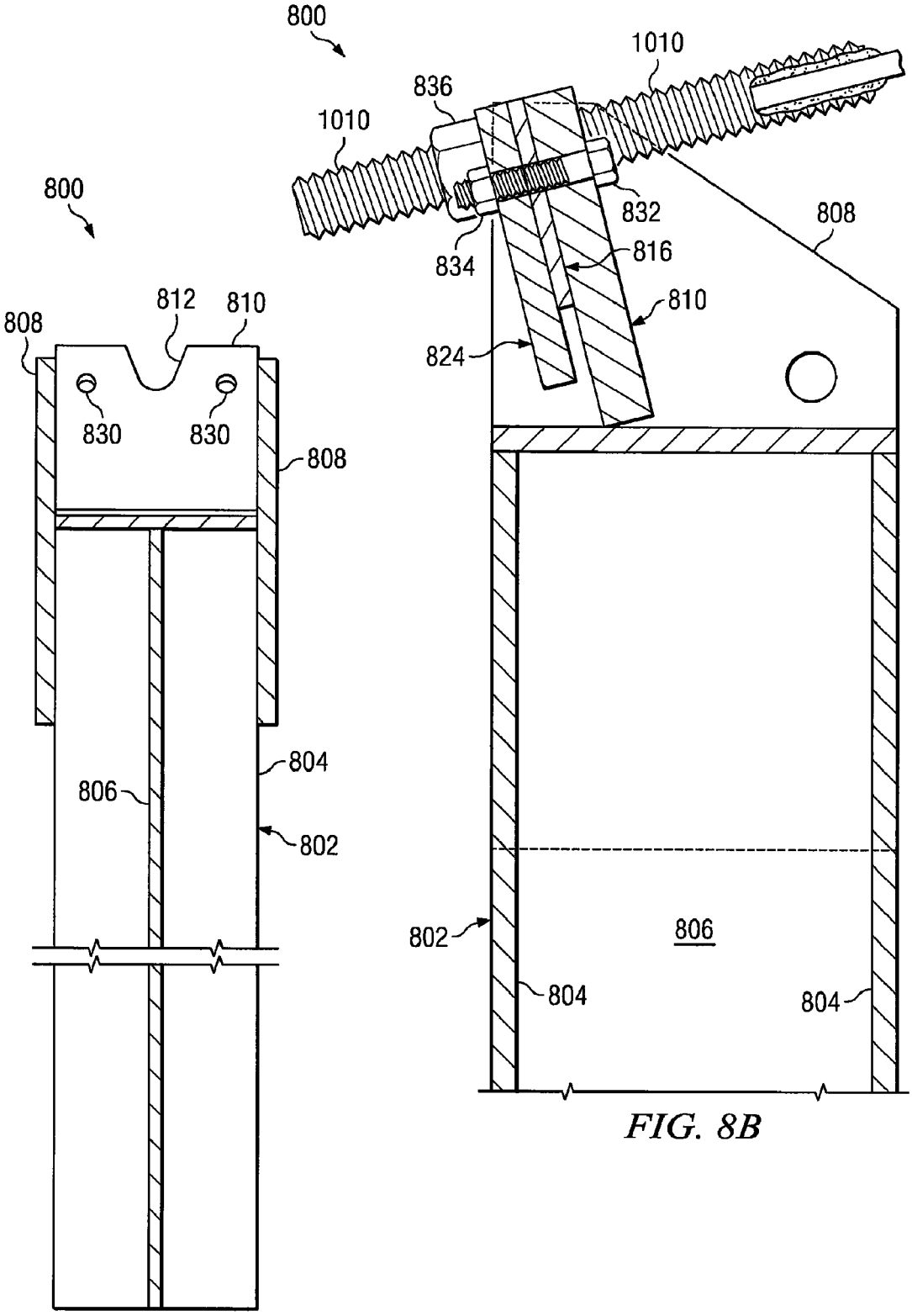
FIGS. 8A and 8B illustrate an exemplary embodiment of a terminal support post for use in a guardrail safety system, in accordance with a particular embodiment of the present invention.

Although certain of the support posts may be configured to release the guardrail beam element upon vehicular impact, it may be desirable for a terminal support post to remain coupled to guardrail beam even after an end-on or re-directive impact. FIGS. 8A and 8B illustrate an example embodiment of a terminal support post 800 that may be used in conjunction with guardrail system 100 of FIG. 1. Referring to FIG. 1, terminal support post 800 is the first terminal support post at the upstream end of terminal section 108. FIG. 8A is a side view of terminal support post 800, and FIG. 8B is a front view of the same terminal support post 800.

In particular embodiments, terminal support post 800 is releasably coupled to guardrail beam 102 such that guardrail beam 102 and provides positive anchorage of guardrail beam 102 to react to tensile loads on guardrail beam 102 to redirect a vehicle impacting laterally along the length of guardrail beam 102. Various components are used to effect the coupling of guardrail beam 102 to terminal support post 800 such that guardrail beam 102 remains coupled to terminal support post 800 when guardrail system 100 is struck by an impacting vehicle in an end-on or re-directive type impact. As a result, guardrail beam element remains supported in tension even after such an impact. However, when guardrail system 100 is struck by an impacting vehicle in the reverse direction, the tensile coupling of guardrail beam 102 will be released from terminal support post 800 to prevent vehicle instability and excessive vehicular deceleration.

In the illustrated embodiment, terminal support post 800 includes a structural member 802 of an I-beam configuration. Structural member 802 includes a pair of flanges 804 interconnected by a central web 806. In a currently preferred embodiment, the beam member 802 comprises a W 6×15 steel post member. A pair of rectangular side plates 808 are affixed opposite sides of structural member 802. Preferably, side plates 808 are secured by welding to each of flanges 804.

A connector assembly is used to couple structural member 802 to the guardrail beam member. The connector assembly is configured such that the coupling of the structural member and the terminal portion of the guardrail beam is maintained during an end-on or re-directive impact by a vehicle. However, the connector assembly is configured to release the coupling during a reverse-direction impact. In a particular embodiment, the connector assembly comprises a plurality of stacked rectangular plates that are aligned to receive the terminal portion of the guardrail beam. For example, the connector assembly may include a stack of three plates: a flange plate 810, a keeper plate 816, and a washer plate 824.

Figure 9A:
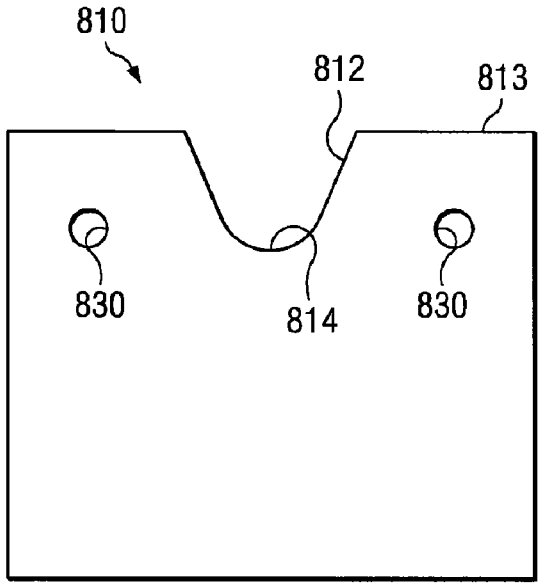
FIGS. 9A-9C illustrate various components of a resistive, tensile connection for connecting a guardrail beam to a terminal support post, in accordance with a particular embodiment of the present invention.

A flange plate 810 is secured between side plates 808. Flange plate 810 is preferably a unitarily formed piece that is secured by welding to structural member 802 and each side plate 808. Flange plate 810, as best shown in FIG. 9A, includes a rectangular plate with a V-shaped cut-out 812 at the center of an upper edge 813 of flange plate 810. In the illustrated embodiment, flange plate 810 has a length of approximately 5 inches and a width of approximately 6 inches. The thickness of flange plate 810, as best shown in FIG. 8B, may be approximately 1 inch.

V-shaped slot 812 is centered along the horizontal width of flange plate 810 and has a vertical length of approximately 1 inch and a horizontal width of approximately 1¾ inches. The rounded bottom 814 of V-shaped slot 812 has a diameter of approximately 1¼ inches. However, the described and depicted dimensions of flange plate 810 are provided for example purposes only. Although the depicted dimensions may be appropriate where structural member 802 includes a W 6×15 steel post member, the dimensions of flange plate 810 may vary and may depend on size and dimensions of structural member 802.

Figure 9B:
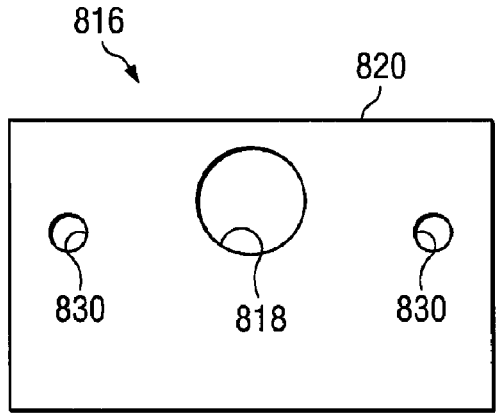

Returning to FIG. 8B, a keeper plate 816 is disposed adjacent to flange plate 810. Similar to flange plate 810, keeper plate 816 is preferably a unitarily formed piece. As best shown in FIG. 9B, keep plate 816 includes a rectangular plate with a circular shaped opening 818 proximate an upper edge 820 of keeper plate 816. In the illustrated embodiment, keeper plate 816 has a vertical length of approximately 3⅛ inches and a horizontal width of approximately 5⅜ inches. Opening 818 is centered along the horizontal width of keeper plate 816 and has a center that is approximately ⅞ inch from upper edge 820 of keeper plate 816. U-shaped opening 818 may have a diameter of approximately 1¼ inches. However, the described and depicted dimensions of keeper plate 816 are provided for example purposes only. Although the depicted dimensions may be appropriate where structural member 802 includes a W 6×15 steel post member, the dimensions of keeper plate 816 may vary and may depend on size and dimensions of structural member 802 and flange plate 810.

Figure 9C:
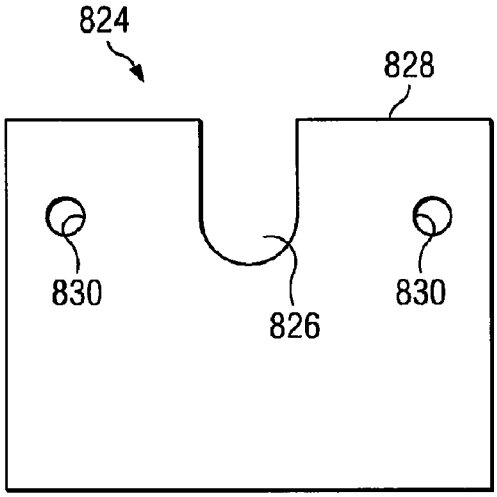

Returning to FIG. 8B, a washer plate 824 is disposed adjacent to keeper plate 816. Similar to flange plate 810 and keeper plate 816, washer plate 824 is preferably a unitarily formed piece. As best shown in FIG. 9C, washer plate 824 includes a rectangular plate with a U-shaped slot 826 at the center of the upper edge 828 of washer plate 824. In the illustrated embodiment, washer plate 824 has a vertical length of approximately 4⅛ inches and a horizontal width of approximately 5½ inches. The thickness of washer plate 824, as best shown in FIG. 8B, may be approximately ½ inch.

U-shaped slot 826 is centered along the horizontal width of washer plate 824 and has a vertical length of approximately 1¼ inches and a horizontal width of approximately 1⅛ inches. The rounded bottom slot 826 has a diameter of approximately 1¼ inches. However, the described and depicted dimensions of washer plate 824 are provided for example purposes only. Although the depicted dimensions may be appropriate where structural member 802 includes a W 6×15 steel post member, the dimensions of washer plate 824 may vary and may depend on size and dimensions of structural member 802.

Each of flange plate 810, keeper plate 816, and washer plate 824 include a pair of boltholes 830. In the illustrated embodiments, boltholes 830 are approximately ⅜ inches in diameter. When assembled together, a bolthole 830 of each of flange plate 810, keeper plate 816, and washer plate 824 are in general alignment with one another. A pair of threaded bolts 832 may be secured through boltholes 830 to secure flange plate 810, keeper plate 816, and washer plate 824 together. A washer 834 may be threaded onto the end of each of the threaded bolts 832 to hold the plates relative to each other.

Figure 10A:
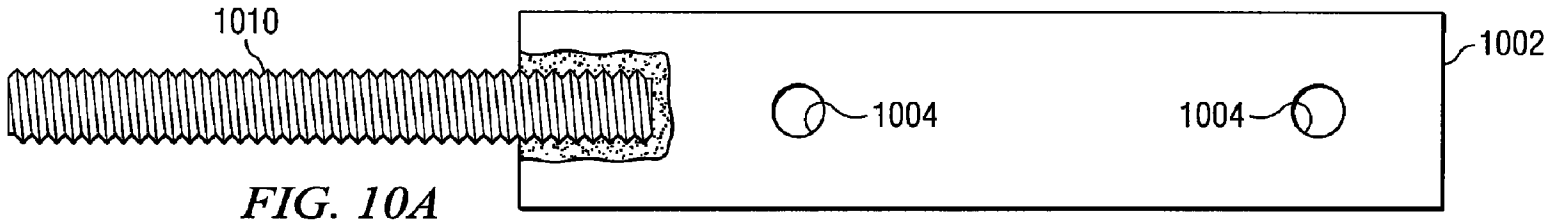
FIGS. 10A and 10B illustrate an exemplary resistive, tensile connection for connecting a guardrail beam to a terminal support post, in accordance with a particular embodiment of the present invention.
Figure 10B:
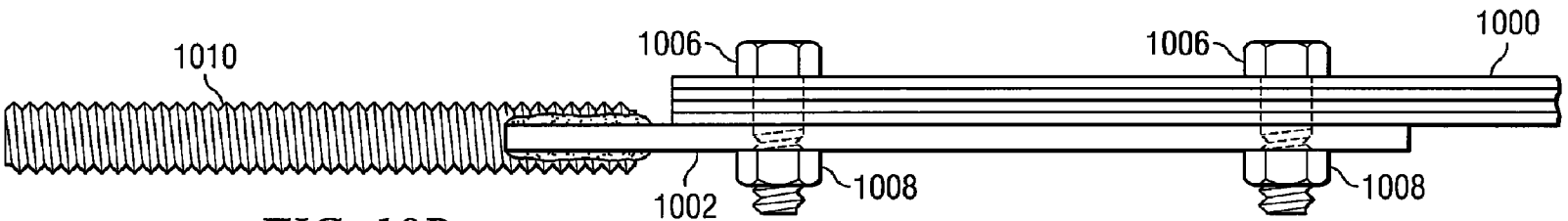

As described above, the purpose of terminal support post 800 is to secure guardrail beam 102 in tension. FIGS. 10A and 10B illustrate an exemplary tensile connection of a guardrail beam 1000 to a terminal support post such as terminal support post 800 depicted in FIGS. 8A and 8B. Specifically, a compressed slotted guardrail beam 1000 similar to those described above with regard to FIGS. 1, 2, and 4A-4B is coupled to a connection plate 1002.

In the illustrated embodiment, connection plate 1002 includes a pair of boltholes 1004, which may be aligned with a pair of similar boltholes (not shown) in the terminal end of the compressed slotted guardrail beam 1000. A pair of threaded bolts 1006 may be threaded through boltholes 1004 and similarly sized boltholes of guardrail beam 1000 (not shown) that are aligned with boltholes 1004. A threaded nut 1008 may secure each connection of bolts 1006 through connection plate 1002 and guardrail beam 1000. In a particular embodiment, the boltholes 1004 and boltholes in guardrail beam 1000 may have a diameter on the order of approximately ⅞ inch. In such an embodiment, threaded bolts 1006 may include 2½×¾" GR. 5 bolts. However, it is recognized that these sizes are provided as examples only. Any appropriate size of boltholes and bolts may used to secure guardrail beam 1000 to connection plate 1002.

Connection plate 1002 is coupled to a threaded rod 1010. In a particular embodiment, threaded rod 1010 may be welded to connection plate 1002. As best shown in FIG. 8B, threaded rod 1010 is threaded through V-shaped cutout 814 of flange plate 810, circular opening 818 of keeper plate 816, and U-shaped cutout 826 of washer plate 824. A nut 836 is threaded on the end of threaded rod 101 to secure guardrail beam 1000 in tension to terminal support post 800.

The presence of nut 836 prevents withdrawal of cable 1010 from the openings formed by V-shaped cutout 814 of flange plate 810 and U-shaped cutout 826 of washer plate 824. Since the opening of keeper plate 816 includes an enclosed circular opening 818 rather than an open cutout in the edge of the keeper plate 816, keeper plate 816 ensures that threaded rod 1010 is properly in place. Keeper plate 816 also adds strength to the tensile connection of threaded rod 1010 to terminal post 800. Washer plate 824, which functions as a washer between bolt 834 and keeper plate 816, also adds strength to the connection.

During an end-on or redirective impact to a guardrail system incorporating the above-described features, the assembly described in FIGS. 8A-8B, 9A-9C, and 10A-10B enables the tensile connection of guardrail beam 1010 to terminal support post 800 to remain intact. Because the guardrail beam 1010 remains in tension, guardrail beam 1010 is able to redirect the impacting vehicle. Column buckling of the system may be eliminated and an eccentric impacting vehicle may remain in the system longer during deceleration.

In contrast, when a vehicle impacts the guardrail system in a reverse direction, the tensile connection of guardrail beam 1010 may be released. For example, the reverse-direction impact may cause the upper edge 820 of keeper plate 816 directly above circular opening 818 to be sheared. Threaded rod 1010 is then freed from the openings formed by V-shaped cutout 812, U-shaped cutout 826, and circular opening 818. Because the tensile connection in guardrail beam 1000 is released, guardrail beam 1000 may be controllably collapsed to prevent vehicle instability or excessive deceleration.

To further aid in the release of the tensile connection during a reverse-direction impact, a modified strut may be used to couple the terminal support post to the first adjacent support post. Such a strut is indicated as reference numeral 140 in FIG. 2 and is illustrated in more detail in FIGS. 1A and 1B. In the illustrated embodiment, strut 140 includes a longitudinal beam member 1112 that has been modified to include a strut plate 1114. Longitudinal beam member 1112 may include have any appropriate cross-sectional shape. The length of longitudinal beam member 1112 is appropriate for coupling terminal support post 106 and the next adjacent support post 104. In a particular embodiment, longitudinal beam member 1112 may include a C-channel member having a width on the order of approximately 6 inches and a depth on the order of approximately 2 inches.

Figure 11B:
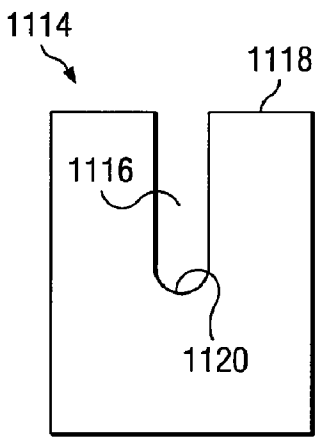
FIGS. 11A and 11B illustrate an exemplary strut for use in a guardrail safety system, in accordance with a particular embodiment of the present invention.
Figure 11A:
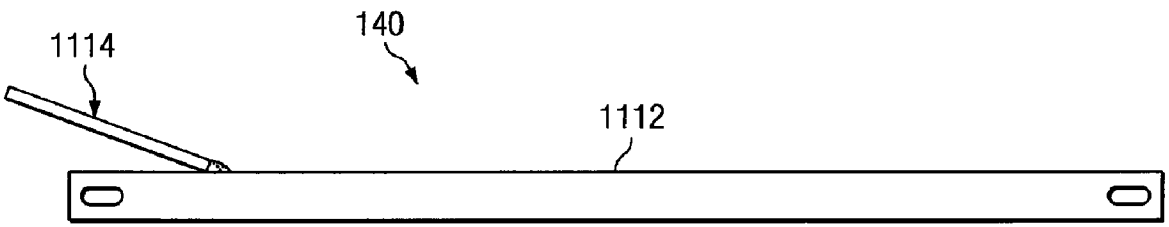

As best shown in FIG. 11B, strut plate 1114 is preferably a unitarily formed piece that is secured by welding to longitudinal beam member 1112. Strut plate 1114 includes a rectangular plate with a U-shaped cut-out 1116 at the center of the upper edge 1118 of strut plate 1114. In the illustrated embodiment, strut plate 1114 has a horizontal dimension of approximately 10 inches and a vertical dimension of approximately 8 inches. The thickness of strut plate 1114 may be approximately ¼ inch. U-shaped slot 1116 is centered along the vertical dimension of strut plate 1114 and has a vertical dimension of approximately 1½ inch and a horizontal dimension of approximately 5½ inches. The rounded bottom 1120 of U-shaped slot 1116 has a diameter of approximately 1½ inches. However, the described and depicted dimensions of strut plate 1114 are provided for example purposes only. The dimensions of strut plate 1114 and longitudinal beam member 1112 may vary.

When a vehicle impacts the guardrail system in a reverse direction, strut 1112 and strut plate 1114 may facilitate the release of the tensile connection between the guardrail beam and the terminal support post. Strut plate 1114 is positioned proximate the outlet end of flattening portion 112. Strut plate 1114 operates as a ramp to facilitate the lifting of the threaded rod coupled to the guardrail beam from the V-shaped cutout 814 of flange plate 810, circular opening 818 of keeper plate 816, and U-shaped cutout 826 of washer plate 824. Because the tensile connection in guardrail beam 1000 is released, strut 1112 and strut plate 1114 prevent instability or excessive deceleration of the impacting vehicle.

Figure 12:
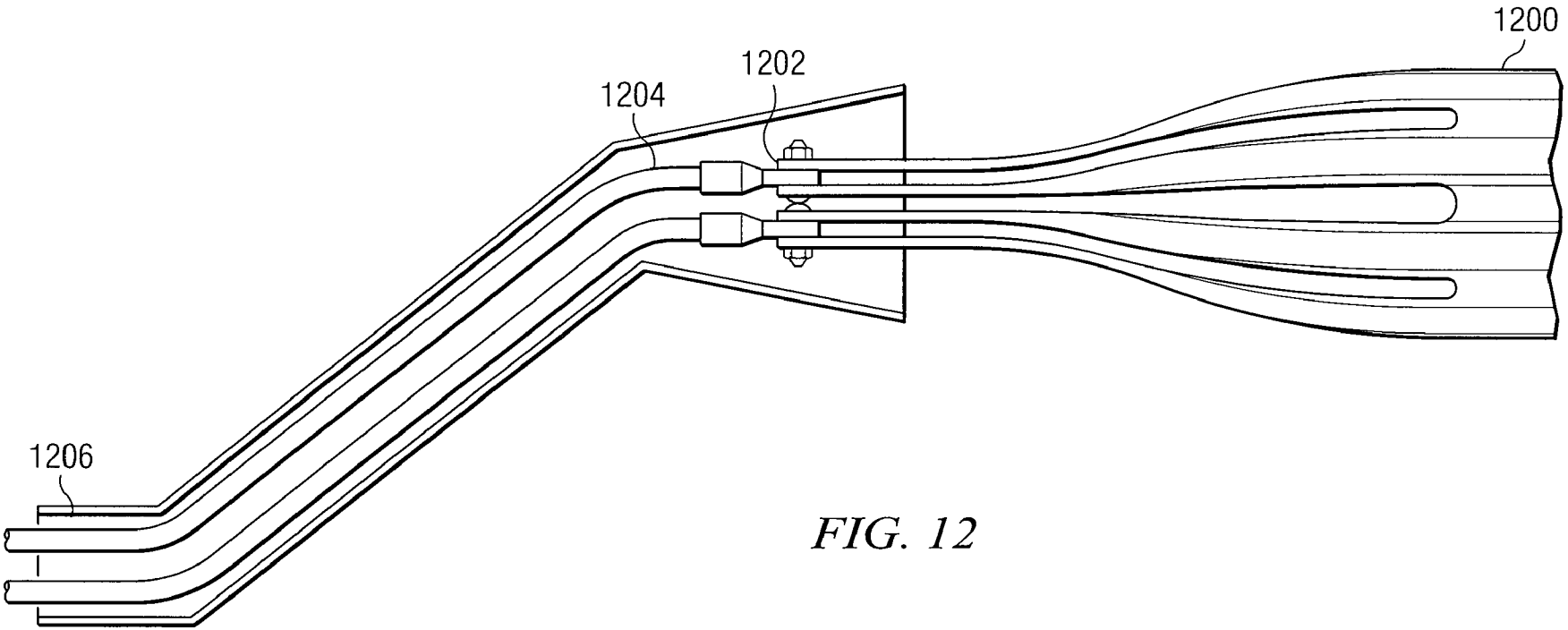
FIG. 12 illustrates an alternative embodiment of a resistive, tensile connection for connecting a guardrail beam to a terminal support post, in accordance with a particular embodiment of the present invention.

As described above, FIGS. 10A and 10B illustrate an exemplary tensile connection of a guardrail beam to a threaded rod. FIG. 12 illustrates an alternative embodiment of a tensile connection that may be used to couple a guardrail beam to a terminal post. In the illustrated embodiment, a slotted guardrail beam 1200 may be modified similar to guardrail beam 200 of FIG. 4A. Slotted guardrail beam 1200 is modified at the terminal end 1202 and is coupled to a cable rod 1204. In a particular embodiment, slotted guardrail beam 1200 may be coupled to a pair of cable rods 1204.

Cable rods 1204 may traverse through a flattening portion 1206. Flattening portion 1206 may be similar to flattening portion 110 of FIGS. 1-3. Accordingly, at least a portion of cable rods 1204 may traverse the length of flattening portion 1206 and exit an outlet 1206 at an upstream end of flattening portion 1206. After exiting the outlet 1206, cable rods 1204 may be secured to a terminal post 106 at ground level using a mechanism similar to that described above with regard to FIGS. 8A-8B, 9A-9C, and 10A-10B.

Technical advantages of particular embodiments of the present invention include a guardrail end treatment that dissipates impact energy through the compression of a W-beam guardrail element. Specifically, the guardrail end treatment may dissipate impact energy of a vehicle colliding with an end of a guardrail by flattening a portion of the guardrail required for deceleration of the impacting vehicle. Another advantage may be that the end treatment forces the W-beam guardrail element through a flattening structure that squeezes the guardrail into a relatively flat plate. In contrast to prior systems, the W-beam guardrail element may be flattened vertically rather than horizontally.

Still another advantage may be that a tensile and resistive coupling may be provided for connecting an end of the W-beam guardrail element to a terminal support post. The components of the system that provide the tensile connection of the guardrail beam to the terminal support post may enable the guardrail beam to remain secured after an end-on or re-directive impact. Thus, the system may remain in tension during both types of impacts. Still another advantage may be that the tension is released when the system is impacted in the reverse direction near the terminal end, however. The releasing of tension in the guardrail element for reverse direction impacts prevents vehicle instability and excessive deceleration.

Although the present invention has been described by several embodiments, various changes and modifications may be suggested to one skilled in the art. It is intended that the present invention encompass such changes and modifications as fall within the scope of the present appended claims. For example, the features described above may be used independently and/or in combination with each other or other design modifications.

What is claimed is:

1. A terminal portion of a guardrail safety system comprising:

a terminal portion of a guardrail beam comprising a downstream end and upstream end, the terminal portion of the guardrail beam sloping from a height appropriate for redirecting an errant vehicle to a height proximate the surface of the ground at an upstream end of the terminal portion;

a plurality of support posts installed adjacent a roadway in spaced apart relation to one another, the plurality of support posts coupled to the terminal portion of the guardrail beam; and a terminal support post installed adjacent the roadway at an upstream end of the terminal portion of the guardrail beam, the terminal support post coupled to an upstream end of the terminal portion of the guardrail beam by a resistive, tensile coupling that maintains tension in the terminal portion of the guardrail beam, the resistive, tensile coupling maintained between the terminal support post and the guardrail beam during an end-on or re-directive impact by a vehicle, the resistive, tensile coupling released between the terminal support post and the guardrail beam during a reverse-direction impact, and wherein the resistive, tensile coupling comprises a connector assembly comprising a plurality of plates stacked adjacent to one another, at least one of the plurality of plates affixed to an end of the terminal support post, the plurality of plates comprising:

a first plate comprising a rectangular plate with a V-shaped cut-out in an upper edge of the rectangular plate;

a second plate comprising a rectangular plate with a circular shaped opening; and a third plate comprising a rectangular plate with a U-shaped cut-out in an upper edge of the third plate; and wherein the V-shaped cut-out, the circular opening, and the U-shaped cut-out are aligned with one another when the first, second, and third plates are stacked adjacent to one another.

2. The terminal portion of claim 1, wherein the terminal portion of the guardrail beam is substantially parallel to the roadway.

3. The terminal portion of claim 1, wherein the terminal portion of the guardrail beam is flared away from the roadway at an upstream end of the guardrail beam.

4. The terminal portion of claim 3, wherein the flare is substantially parabolic.

5. The terminal portion of claim 3, wherein the flare is substantially linear.

6. The terminal portion of claim 1, wherein the guardrail beam member comprises a longitudinally corrugated W-beam having upper and lower peaks and a valley between the peaks.

7. The terminal portion of claim 6, wherein the terminal portion of the guardrail beam member is modified to include a slotted zone, the slotted zone comprising a set of three slots extending longitudinally in each of the upper and lower peaks and the valley between the peaks, the slotted zone increasing the ability of the terminal portion of the guardrail beam member to be flattened.

8. The terminal portion of claim 7, wherein the upstream end of the guardrail beam member is flattened into four vertically stacked plates.

9. The terminal portion of claim 1, wherein the upstream end of the guardrail beam member is coupled to a threaded rod, the threaded rod cooperating with the resistive, tensile coupling to maintain tension in the terminal portion of the guardrail beam upon the end-on or redirective impact by the vehicle.

10. The terminal portion of claim 1, further comprising an impact head coupled to the first support disposed downstream from the terminal support post, the impact head operable to be horizontally displaced in the downstream direction during an end-on collision for the dissipation of impact energy.

11. The terminal portion of claim 1, wherein at least one of the plurality of support posts comprise a modified support post, the modified support post comprising:

a lower portion for installing below grade adjacent the roadway;

a mid portion that lies substantially adjacent the grade, the mid portion including a weakened section operable to weaken the support post about a first axis without substantially changing the behavior of the support post about a second axis that is generally perpendicular to the first axis; and an upper portion releasably coupled to the terminal portion of the guardrail beam.

12. A terminal portion of a guardrail safety system comprising:

a terminal portion of a guardrail beam;

a terminal support post coupled to an upstream end of the terminal portion of the guardrail beam, the terminal support post comprising:

a structural member having a longitudinal axis, the structural member for installing below grade adjacent the roadway;

a connector assembly coupling the terminal portion of the guardrail beam to the structural member at an acute angle relative to the longitudinal axis of the structural member, the connector assembly comprising an opening through which the upstream end of the terminal portion of the guardrail beam is disposed;

wherein the coupling of the structural member and the terminal portion of the guardrail beam is maintained during an end-on or re-directive impact by a vehicle and is released during a reverse-direction impact, wherein the connector assembly comprises a plurality of plates stacked adjacent to one another and disposed at an acute angle relative to the longitudinal axis of the structural member, at least one of the plurality of plates affixed to an end of the structural member, each of the plurality of plates comprising an opening, and wherein the plurality of plates comprise:

a first plate comprising a rectangular plate with a V-shaped cut-out in an upper edge of the rectangular plate;

a second plate comprising a rectangular plate with a circular shaped opening; and a third plate comprising a rectangular plate with a U-shaped cut-out in an upper edge of the third plate; and wherein the V-shaped cut-out, the circular opening, and the U-shaped cut-out are aligned with one another when the first, second, and third plates are stacked adjacent to one another.

13. The terminal portion of claim 12, wherein the structural member comprises a pair of flanges interconnected by a central web.

14. The terminal portion of claim 12, further comprising a plurality of support posts installed adjacent a roadway in spaced apart relation to one another, the plurality of support posts coupled to the terminal portion of the guardrail beam.

15. The terminal portion of claim 14, wherein the terminal portion of the guardrail beam is substantially parallel to the roadway.

16. The terminal portion of claim 14, wherein the terminal portion of the guardrail beam is flared away from the roadway at an upstream end of the guardrail beam.

17. The terminal portion of claim 16, wherein the flare is substantially parabolic.

18. The terminal portion of claim 16, wherein the flare is substantially linear.

19. The terminal portion of claim 12, wherein the guardrail beam member comprises a longitudinally corrugated W-beam having upper and lower peaks and a valley between the peaks.

20. The terminal portion of claim 19, wherein the terminal portion of the guardrail beam member is modified to include a slotted zone, the slotted zone comprising a set of three slots extending longitudinally in each of the upper and lower peaks and the valley between the peaks, the slotted zone increasing the ability of the terminal portion of the guardrail beam member to be flattened.

21. The terminal portion of claim 19, wherein the upstream end of the guardrail beam member is flattened into four vertically stacked plates.

22. The terminal portion of claim 12, wherein the upstream end of the guardrail beam member is coupled to a threaded rod, the threaded rod secured through the opening in the connector assembly.

23. A terminal portion of a guardrail safety system comprising:

a terminal portion of a guardrail beam comprising a downstream end and an upstream end, the terminal portion of the guardrail beam sloping from a first height appropriate for redirecting an errant vehicle to a second height proximate the surface of the ground at an upstream end of the terminal portion;

a plurality of support posts installed adjacent a roadway in spaced apart relation to one another, the plurality of support posts coupled to the terminal portion of the guardrail beam; and a terminal support post coupled to the upstream end of the terminal portion of the guardrail beam, the terminal support post comprising:

a structural member having a longitudinal axis, the structural member for installing below grade adjacent the roadway;

a connector assembly coupling the terminal portion of the guardrail beam to the structural member at an acute angle relative to the longitudinal axis of the structural member, the connector assembly comprising a plurality of plates stacked adjacent to one another, at least one of the plurality of plates affixed to an end of the structural member, the plurality of plates comprising:

a first plate comprising a rectangular plate with a V-shaped cut-out in an upper edge of the rectangular plate;

a second plate comprising a rectangular plate with a circular shaped opening; and a third plate comprising a rectangular plate with a U-shaped cut-out in an upper edge of the third plate; and wherein the V-shaped cut-out, the circular opening, and the U-shaped cut-out are aligned with one another when the first, second, and third plates are stacked adjacent to one another;

and wherein the coupling of the structural member and the terminal portion of the guardrail beam is maintained during an end-on or re-directive impact by a vehicle and is released during a reverse-direction impact.

24. The terminal portion of claim 23, wherein the terminal portion of the guardrail beam is substantially parallel to the roadway.

25. The terminal portion of claim 23, wherein the terminal portion of the guardrail beam is flared away from the roadway at an upstream end of the guardrail beam.

26. The terminal portion of claim 25, wherein the flare is substantially parabolic.

27. The terminal portion of claim 25, wherein the flare is substantially linear.

28. The terminal portion of claim 23, wherein the guardrail beam member comprises a longitudinally corrugated W-beam having upper and lower peaks and a valley between the peaks.

29. The terminal portion of claim 28, wherein the terminal portion of the guardrail beam member is modified to include a slotted zone, the slotted zone comprising a set of three slots extending longitudinally in each of the upper and lower peaks and the valley between the peaks, the slotted zone increasing the ability of the terminal portion of the guardrail beam member to be flattened.

30. The terminal portion of claim 28, wherein the upstream end of the guardrail beam member is flattened into four vertically stacked plates.

31. The terminal portion of claim 23, wherein the upstream end of the guardrail beam member is coupled to a threaded rod, the threaded rod cooperating with connector assembly to maintain tension in the terminal portion of the guardrail beam upon the end-on or redirective impact by the vehicle.

32. The terminal portion of claim 23, further comprising an impact head coupled to the first support disposed downstream from the terminal support post, the impact head operable to be horizontally displaced in the downstream direction during an end-on collision for the dissipation of impact energy.

33. The terminal portion of claim 23, wherein at least one of the plurality of support posts comprise a modified support post, the modified support post comprising:

a lower portion for installing below grade adjacent the roadway;

a mid portion that lies substantially adjacent the grade, the mid portion including a weakened section operable to weaken the support post about a first axis without substantially changing the behavior of the support post about a second axis that is generally perpendicular to the first axis; and an upper portion releasably coupled to the terminal portion of the guardrail beam.

* * * * *